US006234154B1

(12) United States Patent
Spix

(10) Patent No.: US 6,234,154 B1
(45) Date of Patent: May 22, 2001

(54) INTEGRAL PCV SYSTEM

(75) Inventor: Thomas Andrew Spix, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/591,842

(22) Filed: Jun. 12, 2000

(51) Int. Cl.[7] ..... F02M 25/00
(52) U.S. Cl. ..... 123/572
(58) Field of Search ..... 123/572, 573, 123/574

(56) References Cited

U.S. PATENT DOCUMENTS 4,958,613 * 9/1990 Hiraoki et al. ..... 123/572
5,499,604 3/1996 Ito et al. .
6,044,828 * 4/2000 Matsushita ..... 123/572
6,065,458 * 5/2000 Ozeki ..... 123/572

* cited by examiner

*Primary Examiner*—Marguerite McMahon
(74) *Attorney, Agent, or Firm*—Laura C. Hargitt

(57) ABSTRACT

An internal combustion engine comprises an engine block having a crankshaft housed in a crankcase portion of the engine block and a coolant jacket adjacent to cylinder walls defining a coolant passage through the engine block to transfer heat from the cylinder walls to coolant flowing therethrough. An oil separator, formed integrally within said engine block and adjacent the coolant jacket, operates to separate oil from blowby gas accumulating in the crankcase portion and to transfer heat from the coolant passage to warm the blowby gas. The engine further includes a cylinder head mounted on an upper surface of the engine block, which may include a PCV passage to transfer blowby gas from the oil separator to the intake.

10 Claims, 3 Drawing Sheets

INTEGRAL PCV SYSTEM

TECHNICAL FIELD

The present invention relates to a positive crankcase ventilation system for an internal combustion engine.

BACKGROUND OF THE INVENTION

During engine operation, combustion gas may leak between the cylinder and its piston rings into the engine crankcase. The leaked combustion gas is referred to as blowby gas and may comprise unburned intake air/fuel mixture, exhaust gas, oil mist, and water vapor.

A positive crankcase ventilation (PCV) system is typically employed to ventilate the crankcase and recirculate the blowby gas to the intake side of the engine for burning the gas in the combustion chamber. The PCV system takes advantage of the negative pressure in the intake to draw the gas out of the crankcase and may utilize a PCV valve to regulate the flow.

A PCV system may be incorporated as a foul air/oil separator in the cam cover of the engine. In the case where design package restraints make it unworkable to package an adequate separator within the cover, the separator may be attached externally to the cover or engine block. An external hose routes the blowby gas to the intake.

In cold environments, a common concern is freezing of the water vapor component of the blowby gas in an external PCV hose and valve. To minimize the risk of freezing, some PCV systems may include a PCV heater, or an extra hot water-carrying hose routed adjacent the PCV hose, or electrically heating or insulating the PCV hose, but these come at a significant cost.

The need exists for a PCV system which is protected from the risk of freezing without adding substantial cost or complexity to the engine.

SUMMARY OF THE INVENTION

The present invention incorporates a PCV system within the engine block and cylinder head castings to minimize the risk of freezing the PCV system.

A foul air/oil separator is cast integral with the engine block, with chambers to allow oil to separate and drain to the crankcase, while not allowing the foul air to bypass portions of the chambers through the oil drain holes. The chambers are positioned adjacent to water jacket passages used to carry engine-warmed coolant away from the engine to maintain the PCV chambers, and therefore the gas therein, above freezing.

As the blowby gas exits the final chamber of the air/oil separator, it may pass through an orifice in the cylinder head gasket to control the flow rate of the gas, without the need for a PCV valve. A passage within the cylinder head delivers the blowby gas to a short hose to the intake manifold, which transports the gas to the intake side of the engine.

This integral PCV system eliminates the expensive need for PCV-specific gas heaters or insulation of PCV hoses to minimize the risk of freezing.

DESCRIPTION OF THE PREFERRED EMBODIMENT

Figure 1:
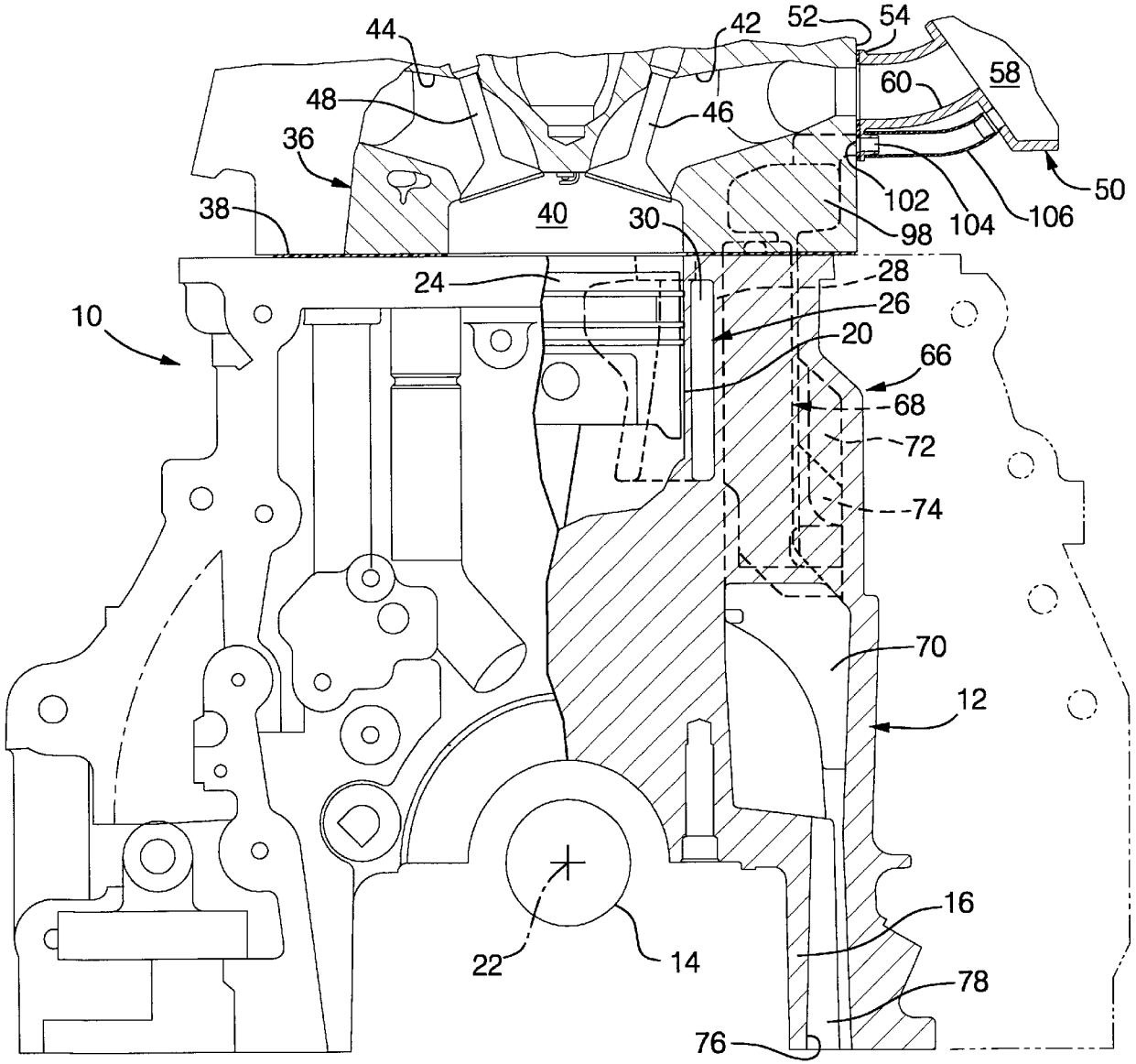
FIG. 1 is a front sectional view of an engine embodying a PCV system of the present invention taken along section 1—1 of FIG. 2.
Figure 2:
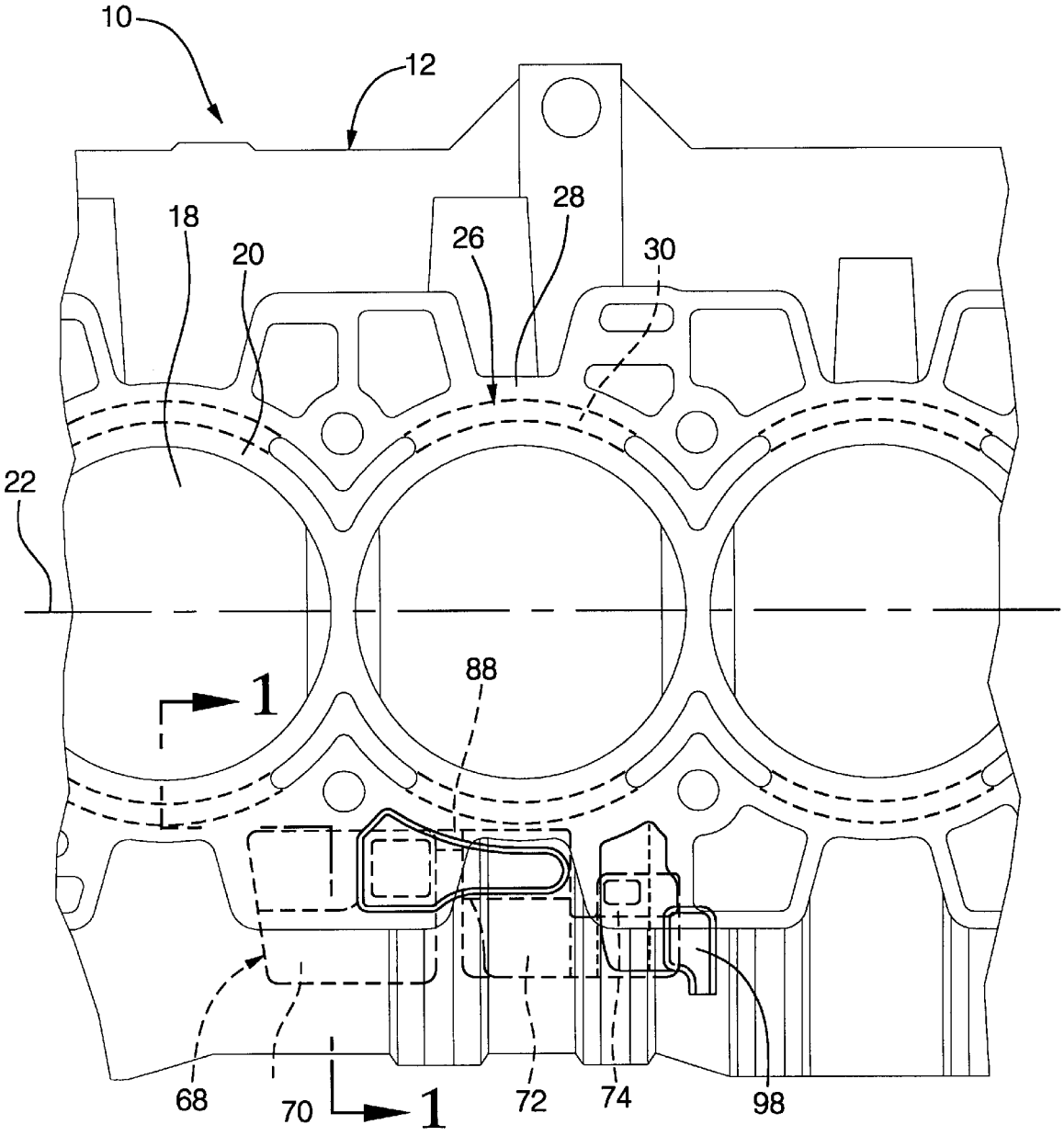
FIG. 2 is a plan view of a portion of the engine block and PCV system of FIG. 1.

FIG. 1 illustrates a portion of an engine, generally 10, comprised of an engine block 12 having a crankshaft 14 housed in a crankcase portion 16 of the block. Cylinders 18, defined by cylinder walls 20, are arranged in series along the longitudinal axis 22 of the engine block 12 as shown in FIG. 2. Each cylinder 18 houses a piston 24 for reciprocation therein during operation. To cool the cylinders 18, an adjacent coolant jacket 26 is provided in the engine block 12. The coolant jacket 26 includes a coolant jacket wall 28, which is generally parallel to the cylinder walls 20 and spaced radially therefrom to create a coolant passage 30. The coolant passage 30 extends from a coolant inlet, not shown, at one end of the engine block 12, along both sides of the cylinders 18, to a coolant outlet, not shown, at the opposing end of the block. Coolant is pumped through coolant passage 30 to transfer heat out of the cylinder walls 20, and is thereby engine-warmed. The engine-warmed coolant also warms the coolant jacket wall 28 of the coolant passage 30.

A cylinder head 36 is mounted to the top of the engine block 12 with a head gasket 38 interposed therebetween. The cylinder head 36 closes each cylinder 18 and cooperates with each piston 24 in forming combustion chambers 40. Each combustion chamber 40 has at least one intake port 42 through the cylinder head 36 to deliver an air/fuel intake mixture and at least one exhaust port 44 to carry exhaust gases away. An intake valve 46 is seated in the intake port 42 and an exhaust valve 48 is seated in the exhaust port 44 adjacent the combustion chamber 40. An intake manifold 50 is mounted to the intake side 52 of the cylinder head 36 through a sealing flange 54. The intake manifold includes an upstream throttle body, not shown, to meter intake charge into an intake plenum 58, which distributes the charge to intake runners 60 aligned with intake ports 42 in the cylinder head 36.

During engine operation, the intake stroke of the piston 24 draws intake air through the intake manifold 50 and intake port 42 to the combustion chamber 40. During the power stroke, a small portion of the combustion gas blows by the piston 24, and piston rings, and into the crankcase portion 16 of the engine block 12. This combustion or blowby gas includes corrosive exhaust gas, unburned air/fuel intake mixture, oil mist, and water vapor. Therefore, the engine 10 requires a positive crankcase ventilation (PCV) system, shown generally as 66 in FIG. 3, to ventilate the crankcase 16 and recirculate the blowby gas to the intake side of the engine to be burned in the combustion chamber 40.

The integral PCV system 66 of the present invention will now be discussed with additional reference to FIG. 3. The PCV system 66 includes an air/oil separator 68 cast integral to the engine block 12 to separate oil from the blowby gas for recombustion. In the preferred embodiment, the separator 68 is labyrinthine in structure with three adjacent chambers, a first chamber 70, a second chamber 72, and a third chamber 74, each stepped up in height from the previous chamber to allow gravity to drain separated oil back to the crankcase 16.

The separator 68 is in flow communication with the crankcase 16 via a crankcase opening 76 at a lower end 78 of the first chamber 70 to draw blowby gas out of the crankcase and into the PCV system 66. An upper transfer passage 80 bridges the first and second chambers 70,72 at an upper end 82 of the separator 68 to transfer blow by gas into the adjacent second chamber 72. The upper transfer passage 80 may be cast integral to the cylinder head 36. The floor 84 of the second chamber 72 is at a height intermediate the height of the first chamber 70, making the second chamber stepped up from the first.

A lower end 86 of the second chamber 72 has an oil drainage conduit 88 connecting the second to the first chamber 70, where the drainage conduit is sloped up so that the conduit is higher in the first chamber than in the second chamber. The drainage conduit 88 operates as a small "sink trap" where oil fills the conduit to block gas flow from bypassing part of the first and second chambers 70,72, while allowing oil to trickle out of the second chamber.

A lower transfer passage 90 bridges the second and third chambers 72,74 from the lower end 86 of the second chamber 72 to a lower end 92 of the third chamber 74. The floor 94 of the third chamber 74 is at a height intermediate the height of the second chamber 72 and therefore the third chamber is stepped up from the second chamber. The upper end 82 of the separator 68 has a gas outlet 96 through the third chamber 74 to transfer blowby gas to a cast-in PCV passage 98 in the mating cylinder head 36.

The separator 68 operates to separate oil from the foul air of the blowby gas. As shown in FIG. 3 by the large open arrows, foul air flows in the crankcase opening 76 and through the labyrinthine-structured separator 68, where oil adheres to the chamber walls. Oil then drains via gravity from the third chamber 74 into the second chamber 72 through the lower transfer passage 90, from the second chamber 72 into the first chamber 70 through the drainage conduit 88, and finally to the crankcase 16 through the crankcase opening 76 in the first chamber 70 as shown by the small arrows. The separator 68 is described as having three chambers but one or more chambers are also contemplated.

To effectively prevent the blowby gas from freezing, the separator chambers 70,72,74 are cast as part of the engine block 12 adjacent to the coolant jacket wall 28 as best shown in FIG. 1. Coolant is pumped into the engine coolant passage 30 and by the cylinder walls 20 where combustion heat is transferred to the coolant. The coolant passages 30 are routed in close proximity to the separator 68, such that heat from the engine-warmed coolant is transferred to the blowby gas therein. Since water vapor is a component of blowby gas, there is a risk that the blowby gas may condense and freeze if it is not warmed.

Figure 3:
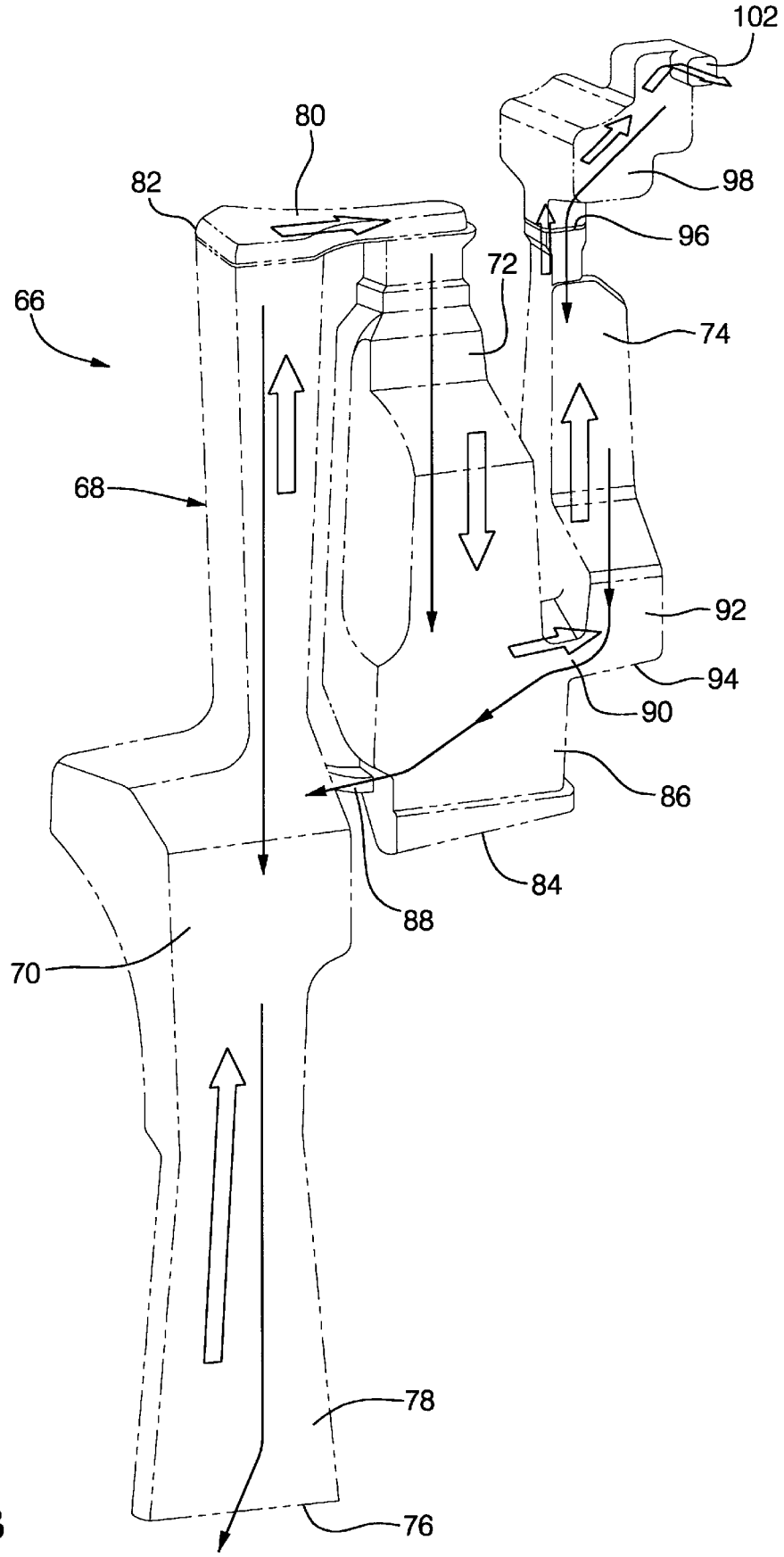
FIG. 3. is an isometric view of the chambers of the PCV system.

The cylinder head gasket 38 has a small aperture, not shown, aligned with the gas outlet 96 from the separator 68 in FIG. 3 and operates as a flow restrictor to control the flow of blowby gas to the intake. It supplants a commonly employed PCV valve. The cast-in PCV passage 98 in the cylinder head 36 extends from the aperture in the head gasket 38 to a side outlet 102 in the intake side 52 of the head. The PCV passage 98 may be routed adjacent to cylinder head water passages to further heat the blowby gas. The intake manifold flange 54 has a tube nipple 104, molded from plastic, aligned with the side outlet 102 of the PCV passage 98 in the cylinder head 36. A short PCV hose 106 attaches to the tube nipple 104 on the intake manifold flange 54 and to a second tube nipple to the intake plenum 58. This PCV hose 106 may be composed of rubber or nylon. In place of a PCV hose, an intake manifold passage may be molded into the intake manifold which extends between the side outlet of the PCV head passage to the plenum.

During engine operation, blowby gas accumulates in the crankcase. Negative pressure in the intake plenum 58 (just downstream of the throttle valve) draws the blowby gas into the PCV system 66, and more specifically, into the cast-in-the-block separator 68. Oil is separated from the gas and drains back to the crankcase 16. Engine-warmed coolant flowing through adjacent coolant passages 30 warms the blowby gas in the separator 68. The gas passes through the aperture in the cylinder head gasket 38 and through the cast-in PCV passage 98 in the cylinder head 36, where it is delivered to the PCV hose 106 connecting to the intake plenum 58 and becomes a component of the intake charge.

The PCV system of the present invention provides an inexpensive means for returning blowby gas to the intake system without the risk of freezing a PCV valve or the throttle valve. The separator of the present invention is not limited to the exact structure of three chambers, but rather to having the chambers cast integral in the block adjacent to the water passage.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An internal combustion engine, comprising:

an engine block having a crankshaft housed in a crankcase portion of said engine block, cylinders defined by cylinder walls for housing pistons, a coolant jacket adjacent to said cylinder walls defining a coolant passage through said engine block to transfer heat from said cylinder walls to coolant flowing therethrough, and an integral oil separator adjacent said coolant jacket and in flow communication with said crankcase portion, operable to separate oil from blowby gas and to transfer heat from said coolant passage to said blowby gas, said engine further including a cylinder head mounted on an upper surface of said engine block with a head gasket interposed therebetween, said cylinder head having an intake port to receive intake charge from an intake manifold and an exhaust port for each of said cylinders.

2. An internal combustion engine, as defined in claim 1, wherein said integral oil separator is labyrinthine in structure having a first chamber with an opening to said crankcase portion, a second chamber adjacent to and stepped up from said first chamber, a transfer passage between said first and second chambers to transfer blowby gas therebetween, and an oil drainage conduit for draining separated oil from said second chamber to said first chamber.

3. An internal combustion engine, as defined in claim 1, wherein said cylinder head further includes an integral PCV passage to transfer blowby gas from said separator in said engine block to said intake manifold.

4. An internal combustion engine, as defined in claim 3, wherein said head gasket includes an aperture to regulate flow of blowby gas from said integral oil separator to said PCV passage in said cylinder head.

5. An internal combustion engine, as defined in claim 4, wherein said integral oil separator is labyrinthine in structure having a first chamber with an opening to said crankcase portion, a second chamber adjacent to and stepped up from said first chamber, a transfer passage between said first and second chambers to transfer blowby gas therebetween, and an oil drainage conduit for draining separated oil from said second chamber to said first chamber.

6. An internal combustion engine, as defined in claim 4, wherein said separator further comprises a third chamber adjacent to and stepped up from said second chamber, a lower transfer passage between said second and third chambers to transfer blowby gas therebetween and for draining oil from said third chamber to said second chamber, and a gas outlet from said third chamber to said PCV passage in said cylinder head.

7. An internal combustion engine, comprising:

an engine block having a crankshaft housed in a crankcase portion of said engine block, cylinders defined by cylinder walls for housing pistons, a coolant jacket adjacent to said cylinder walls defining a coolant passage through said engine block to transfer heat from said cylinder walls to coolant flowing therethrough, a cylinder head mounted on an upper surface of said engine block with a head gasket interposed therebetween, said cylinder head having an intake port to receive intake charge and an exhaust port for each of said cylinders, an intake manifold including an intake plenum to distribute intake charge to intake runners, aligned with said intake ports, and a PCV system including an oil separator, labyrinthine in structure, to separate oil from blowby gas accumulating in said crankcase portion and having a first chamber with an opening to said crankcase portion, a second chamber adjacent to and stepped up from said first chamber, an upper transfer passage between said first and second chambers to transfer blowby gas therebetween, and an oil drainage conduit for draining separated oil from said second chamber to said first chamber, a third chamber adjacent to and stepped up from said second chamber, a lower transfer passage between said second and third chambers to transfer blowby gas therebetween and for draining oil from said third chamber to said second chamber, and a gas outlet from an upper end of said third chamber, wherein said chambers of said separator are formed integrally within said engine block and adjacent said coolant jacket to transfer heat from said coolant passage to said blowby gas, said PCV system further including a PCV passage formed integrally within said cylinder head wherein an aperture in said head gasket regulates flow of blowby gas from said separator to said PCV passage which delivers blowby gas to said intake manifold.

8. An internal combustion engine, as defined in claim 7, wherein said upper transfer passage connecting said first and second chambers is formed integrally within said cylinder head.

9. An internal combustion engine, as defined in claim 7, wherein said PCV system further comprises a PCV hose to transfer blowby as from said PCV passage at a side outlet in said cylinder head to said intake manifold.

10. An internal combustion engine, as defined in claim 7, wherein said intake manifold further comprises an integral intake manifold passage extending from said PCV passage at a side outlet in said cylinder head to said intake plenum.

* * * * *